US011858021B2

(12) United States Patent
Kerschensteiner et al.

(10) Patent No.: US 11,858,021 B2
(45) Date of Patent: Jan. 2, 2024

(54) PREVENTING UNDULATIONS WHEN ROLLING METAL STRIPS

(71) Applicants: Primetals Technologies Austria GmbH, Linz (AT); Primetals Technologies Germany GmbH, Erlangen (DE)

(72) Inventors: Martin Kerschensteiner, Berg (DE); Daniel Kotzian, Forchheim (DE); Matthias Kurz, Erlangen (DE); Klaus Loehe, Fürth (DE); Andreas Maierhofer, Marloffstein (DE); Daniel Ott, Linz (AT); Mirko Tunk, Heroldsbach (DE)

(73) Assignees: PRIMETALS TECHNOLOGIES AUSTRIA GMBH; PRIMETALS TECHNOLOGIES GERMANY GMBH

( * ) Notice: Subject to any disclaimer, the term of this patent is extended or adjusted under 35 U.S.C. 154(b) by 152 days.

(21) Appl. No.: 17/598,343

(22) PCT Filed: Mar. 5, 2020

(86) PCT No.: PCT/EP2020/055886
§ 371 (c)(1),
(2) Date: Sep. 27, 2021

(87) PCT Pub. No.: WO2020/193099
PCT Pub. Date: Oct. 1, 2020

(65) Prior Publication Data

US 2022/0250128 A1 Aug. 11, 2022

(30) Foreign Application Priority Data

Mar. 27, 2019 (EP) ..... 19165536

(51) Int. Cl.
*B21B 37/68* (2006.01)
*B21B 37/30* (2006.01)
(Continued)

(52) U.S. Cl.
CPC ..... *B21B 37/68* (2013.01); *B21B 37/30* (2013.01); *B21B 37/58* (2013.01); *B21B 38/02* (2013.01); *B21B 2263/04* (2013.01)

(58) Field of Classification Search
CPC ..... B21B 37/68; B21B 37/30; B21B 37/58; B21B 38/02; B21B 2263/04;
(Continued)

(56) References Cited

U.S. PATENT DOCUMENTS 10,456,818 B2 10/2019 Kurz et al.
10,908,566 B2 2/2021 Gafur et al.
2010/0269556 A1* 10/2010 Moretto ..... B21B 37/68 72/12.5

FOREIGN PATENT DOCUMENTS

CN 101905248 A 12/2010
CN 108602100 A 9/2018
(Continued)

OTHER PUBLICATIONS

English translate (EP3202502A1), retrieved date Apr. 22, 2023.*
(Continued)

*Primary Examiner* — Matthew Katcoff
*Assistant Examiner* — Mohammed S. Alawadi
(74) *Attorney, Agent, or Firm* — OSTROLENK FABER LLP

(57) ABSTRACT

A control device (3*b*) for a roll stand (1). During rolling of a metal strip (2) in the roll stand (1), the device receives measurement data (M) for a lateral position (y) of the metal strip (2) on the inlet side and/or outlet side of the roll stand (1). Taking into account parameters (P) of the stand regulator
(Continued)

(3*a*) on the basis of the deviation in the lateral position (y) from a target position (y*), a stand regulator (3*a*) of the control device (3*b*) determines a tilt value (δs) for the roll stand (1) and controls the roll stand (1) accordingly. The control device (3*b*) determines at least one variable (V1, V2, Q1, Q2) from which it is derived, for both strip edges (7, 8) of the metal strip (2), whether the metal strip (2) forms an undulation (9) in the region of the particular strip edge (7, 8). As soon as the metal strip (2) forms an undulation (9) in the region of one of the strip edges (7, 8), the control device (3*b*) varies at least one of the parameters (P) of the stand regulator (3*a*), such that the stand regulator (3*a*) determines the tilt value (δs), starting from the variation in the at least one parameter (P), and taking into account the changed parameter (P).

15 Claims, 7 Drawing Sheets

(51) Int. Cl.
*B21B 37/58* (2006.01)
*B21B 38/02* (2006.01)

(58) Field of Classification Search
CPC ..... B21B 2263/06; B21B 2271/025; B21B 2273/04; B21B 2273/20
See application file for complete search history.

(56) References Cited

FOREIGN PATENT DOCUMENTS

| | | | | | |
|---|---|---|---|---|---|
| DE | 10 2014 215 397 | A1 | | 2/2016 | |
| EP | 2 258 492 | A1 | | 12/2010 | |
| EP | 3 202 502 | A1 | | 8/2017 | |
| EP | 3202502 | A1 | * | 8/2017 | ..... B21B 37/68 |
| JP | S46-11244 | Y1 | | 4/1971 | |
| JP | S59189012 | A | * | 10/1984 | |
| JP | S60-6214 | A | | 1/1985 | |
| JP | S63-171213 | A | | 7/1988 | |
| JP | H06-147856 | A | | 5/1994 | |
| JP | H08-54217 | A | | 2/1996 | |
| JP | H11-28510 | A | | 2/1999 | |
| JP | 2001-343223 | A | | 12/2001 | |
| JP | 2010-243248 | A | | 10/2010 | |
| KR | 101466168 | B1 | * | 11/2014 | |
| KR | 10-1482468 | B1 | | 1/2015 | |
| WO | WO 2006/063948 | A1 | | 6/2006 | |
| WO | WO 2015/124363 | A1 | | 8/2015 | |
| WO | WO 2016/198246 | A1 | | 12/2016 | |
| WO | WO 2017/111222 | A1 | | 6/2017 | |

OTHER PUBLICATIONS

English translate (JPS59189012A), retrieved date Apr. 22, 2023.*
English translate (KR101466168B1), retrieved date Apr. 22, 2023.*
Chinese Office Action, dated Jan. 10, 2023, issued in corresponding Chinese Patent Application No. 202080025270.1.
Japanese Notice of Allowance, dated Apr. 3, 2023, issued in corresponding Japanese Patent Application No. 2021-557146.
Japanese Office Action, dated Nov. 7, 2022, issued in corresponding Japanese Patent Application No. 2021-557146.
International Search Report dated May 19, 2020 in corresponding PCT International Application No. PCT/EP2020/055886.
Written Opinion dated May 19, 2020 in corresponding PCT International Application No. PCT/EP2020/055886.
European Search Report dated Sep. 13, 2019 in corresponding European Patent Application No. 19165536.4.
Zhong-Qiu Zhao et al., "Object Detection with Deep Learning: A Review," Journal of Latex Class Files, vol. 14, No. 8, 21 pages, Mar. 2017.

* cited by examiner

PREVENTING UNDULATIONS WHEN ROLLING METAL STRIPS

CROSS-REFERENCE TO RELATED APPLICATIONS

The present application is a 35 U.S.C. §§ 371 national phase conversion of PCT/EP2020/055886, filed Mar. 5, 2020, the contents of which are incorporated herein by reference which, claims priority of European Patent Application No. 19165536.4, filed Mar. 27, 2019, the contents of which are incorporated by reference herein. The PCT International Application was published in the German language.

FIELD OF THE ART

The present invention is based on a control method for a roll stand. While a metal strip is being rolled in the roll stand, a control device for the roll stand receives measurement data for a lateral position of the metal strip that exists on the entry side and/or on the exit side of the roll stand. A stand controller of the control device takes account of parameters of the stand controller in taking the deviation in the lateral position from a desired position as a basis for ascertaining a pivot value for the roll stand and actuating the roll stand accordingly.

The present invention is additionally based on a control program which comprises machine code that can be executed by a control device for a roll stand, wherein the execution of the machine code by the control device causes the control device to perform a control method of this kind.

The present invention is additionally based on a control device for a roll stand, which is programmed with a control program of this kind. As a result of the control program, the control device performs a control method of this kind during operation.

The present invention is additionally based on a roll unit, which has a roll stand in which a metal strip is rolled, wherein the roll unit has a control device of this kind and the roll stand is controlled by the control device.

The present invention is additionally based on a rolling mill train, which has multiple roll stands that are arranged in succession, as seen in a rolling direction. As a result, the roll stands carry the same section of the metal strip one after the other, wherein at least one of the roll stands is in the form of a roll unit of this kind.

PRIOR ART

When rolling a metal strip in a roll stand, the lateral position of the metal strip is an important process quantity. In the prior art and also in the present invention, the term "lateral position the metal strip" can mean the average lateral position transverse position of the metal strip in a single-stand or multi-stand rolling mill train. Within the context of the present invention, however, it is possible to use this term to denote the transverse position of a longer or shorter section of the metal strip, in extreme cases the transverse position of a specific point on the strip, and in particular the strip head or the strip tail. In particular, when rolling the head of the metal strip, the lateral position of the metal strip is significant so that the metal strip enters a downstream device, for example the downstream roll stand or a coil box, as centrally as possible. Deviations in the lateral position from a desired position can lead to faults, and in extreme cases to cobbles.

To prevent such faults, it is a known practice to detect the lateral position of the metal strip and to pivot the rolls of the roll stand in an appropriate manner in order to adjust and track the lateral position of the metal strip accordingly. For illustration, reference can be made to EP 3 202 502 A1.

When rolling a metal strip, there is also the possibility of a wave forming in the rolled metal strip. In some cases, this occurs despite an attempt to bring the lateral position of the metal strip closer to the desired position, and in other cases, precisely because of the attempt to bring the lateral position of the metal strip closer to the desired position. Depending on its position in the individual case, the wave can occur in the region of the strip edge of the metal strip that faces the drive side of the roll stand or in the region of the strip edge of the metal strip that faces the operator side of the roll stand. Waves of this kind make it difficult at least to supply the metal strip to the downstream device, for example to thread in the metal strip in a downstream stand. Additionally, the waves can lead to a so-called doubled strip, i.e. a double layer of the metal strip, and hence to a fault during operation of the roll stand. In the worst case, a so-called cobble can even arise. The waves in the rolled metal strip can in particular be caused by an asymmetric adjustment of the roll stand that is unsuitable for the specific metal strip being rolled.

Whether and possibly to what extent such waves arise cannot be determined in advance in the present prior art on the basis of installation, operating and measurement data. The reason is that other, unmeasurable and also otherwise unknown quantities besides measurable and known quantities also have a significant influence. The measurable and known quantities are for example strip thickness, strip width, temperature, roll crown, roll adjustment and so on. The unmeasurable and also otherwise unknown quantities are, for example, relative to this roll stand, a thickness wedge that is present in the as yet unrolled metal strip or a temperature gradient that is present in the as yet unrolled metal strip, and also a deviation in an actual setting of the roll stand from a desired setting.

It is a known practice in the prior art to use an appropriate camera device to capture images of the rolled metal strip on the entry side of the roll stand and to evaluate the images. In the prior art, however, the evaluation is performed only to capture and ascertain the position of the strip edge or, generally, the lateral position of the metal strip, in particular to ascertain a strip camber. For illustration, reference can be made to the aforementioned EP 3 202 502 A1. WO 2006/063 948 A1 also shows this. The same applies to WO 2016/198 246 A1.

SUMMARY OF THE INVENTION

The object of the present invention is to provide ways of avoiding waves in the rolled metal strip, where possible. The object is achieved by a control method herein.

According to the invention, a control method of the type cited at the outset is configured such that the control device ascertains at least one quantity for both strip edges of the metal strip that reveals whether the metal strip is forming a wave in the region of the respective strip edge. As soon as the metal strip forms a wave in the region of one of the strip edges, the control device varies at least one of the parameters of the stand controller. As a result, the stand controller ascertains the pivot value from the varying of the at least one parameter onward in the light of the altered parameter.

In particular, the control device varies the parameter such that the formation of the wave is prevented or to the extent to which the wave forms is limited to a predetermined degree.

The parameter can be determined as required. In particular, the parameter can be a maximum value or a minimum value for the pivot value. For example, it is possible to declare a limit value for the wedge adjustment of the roll stand in the direction in which the wave has occurred at the strip edge. For the other direction, it is possible to retain the limit value there without alteration, provided that such a limit value is present. Alternatively, it is possible to declare a common absolute limit value for the wedge adjustment of the roll stand for both pivot directions.

In individual cases, it is possible to determine the parameter such that it does not yet influence the pivot value currently output by the stand controller. This can be useful in particular if the sensitivity for detection of a wave is very high, meaning that just a very small wave can be detected. In this case, it can sometimes suffice to declare the limit value to have a value slightly above or below the current value, depending on the pivot direction. Normally, however, the control device will declare the limit value such that the stand controller has to reduce the absolute value of the current pivot value based on the varying of the parameter.

Preferably, the control device retains the varied parameter until either the control device varies the parameter again on the basis of a further formation of a wave in the metal strip, or the tensile state of the metal strip changes or the metal strip has been completely rolled in the roll stand.

The tensile state determines whether the metal strip is rolled under tension or is rolled without being under tension. When the strip position is captured on the exit side and evaluation reveals a wave, the region adjoining the strip head is rolled without tension until the strip head enters a downstream device, for example is threaded into the downstream roll stand. Similarly, when the strip position is captured on the entry side and evaluation reveals a wave, the region adjoining the strip tail is rolled without tension from the moment at which the strip tail has exited an upstream device, for example is threaded out of the upstream roll stand. The remaining region of the metal strip can be rolled under tension which is usually the case or without tension as required.

Preferably, the control device supplies the varied parameter to a database in association with data that are characteristic of the rolled metal strip. As a result, the varied parameter is available as an initial value for the parameter when a further metal strip having the same or sufficiently similar characteristic data is rolled. The effect that can be achieved thereby is that, when rolling a further metal strip having the same or sufficiently similar characteristic data, the parameters of the stand controller are, from the outset, set such that a wave is avoided or the extent of a wave is limited to a predetermined degree. In particular, this thereby prevents another wave from occurring when rolling a subsequent similar or at least comparable metal strip.

The measurement data that the control device can receive for the lateral position of the metal strip are in particular groups of images of the metal strip that show the metal strip as it exits the roll stand and/or as it enters the roll stand. The images of the groups are each being referenced to a capture time that is consistent for the respective group. The capture of such images by cameras and similar optical capture devices is known generally as already explained above.

It is possible for each of the groups to comprise only a single image in individual cases. An evaluation is already possible in a very reliable manner in this case. Additionally, it is possible for the groups of images to have been determined such that they allow a three-dimensional determination of the surface of the metal strip. This improves the evaluation further still.

For example, the groups of images can comprise at least one depth image. The term "depth image" has a specific meaning. It relates to a two-dimensional image in which each picture element also has an associated piece of distance information in addition to its arrangement of the associated object as determined by the arrangement of the picture element in the image. This means that the associated object is clearly located in three-dimensional space. Normally as an alternative, but in principle also in addition, it is possible for the groups of images to comprise multiple two-dimensional images. In this case, the multiple images of the respective group can be used to generate a stereoscopic image, that is a three-dimensional image.

A particularly preferred configuration of the control method provides for the control device to ascertain the at least one quantity that reveals, for both strip edges of the metal strip, whether the metal strip is forming a wave in the region of the respective strip edge, on the basis of the groups of images of the metal strip.

An algorithm for ascertaining the waves in the images does not have to be explicitly created. Rather, it is possible to apply so-called machine learning algorithms in a learning phase. For example, neural networks can be appropriately trained. Purely by way of illustration, reference can be made in this context to the technical paper "Object Detection with Deep Learning: A Review" by Zhong-Qiu Zhao et al., published in Journal of Latex Class Files, vol. 14, No 8, March 2017. Other approaches are also readily possible.

In the simplest case, it is possible for the control device to use the respective group of images to ascertain a respective extent to which the metal strip forms the wave in the region of the respective strip edge, to compare the respective ascertained extent with a threshold value, and to ascertain the at least one quantity on the basis of the respective comparison as a respective Boolean variable.

In this case, the control device thus makes a simple binary decision regarding whether a wave is forming at one strip edge or at the other strip edge. This variant is relatively simple to implement.

However, it is better if the control device uses the respective group of images to quantitatively ascertain a respective extent to which the metal strip forms the wave in the region of the respective strip edge, and uses the quantified values as at least one quantity.

In this case, not only a binary statement but also a quantified statement about the formation of a wave is available. The quantified values can be ascertained by the control device in the form of I units, also known as a flatness index, for example. I units are known and familiar to a person skilled in the art.

The control method according to the invention is in particular performed during a period when the metal strip is in a relaxed state upstream and/or downstream of the roll stand, that is the roll stand on which the stand controller is acting.

The object is additionally achieved by a control program. According to the invention, the execution of the machine code by the control device causes the control device to perform a control method according to the invention.

According to the invention, the control device is programmed with a control program according to the invention.

As a result, the control device performs a control method according to the invention during operation.

According to the invention, the roll unit has a control device.

The object is additionally achieved by a rolling mill train, wherein at least one of the roll stands is in the form of a roll unit according to the invention.

BRIEF DESCRIPTION OF THE DRAWINGS

The properties, features and advantages of this invention that are described above and the way in which they are achieved will become clearer and more distinctly comprehensible in connection with the description of the exemplary embodiments that follows, said exemplary embodiments being explained in more detail in conjunction with the drawings, in which, in a schematic representation.

DESCRIPTION OF THE EMBODIMENTS

Figure 1:
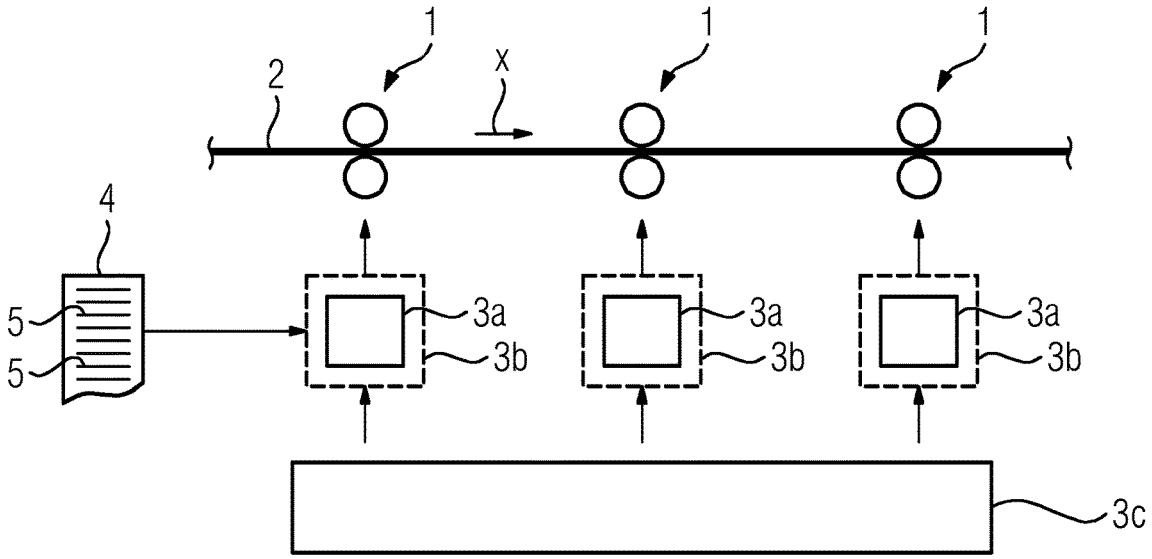
FIG. 1 shows a multi-stand rolling mill train.

According to FIG. 1, a rolling mill train has multiple roll stands 1. Only the working rolls from the roll stands 1 are depicted in FIG. 1. Normally, the roll stands 1 additionally have at least support rolls, and in some cases additionally further rolls beyond the support rolls. For example, there may be intermediate rolls arranged between the working rolls and the support rolls. A metal strip 2 is being rolled in the rolling mill train. Each of the roll stands 1 is controlled by a respective stand controller 3*a*. The stand controllers 3*a* are part of a respective control device 3*b* for the respective roll stand 1. The control devices 3*b* can be coordinated by a higher-level coordination device 3*c*, although this is not absolutely necessary.

The roll stands 1 are arranged in succession in a rolling direction x. The roll stands 1 therefore carry the same section of the metal strip 2 one roll stand after the other. The metal strip 2 can be made from steel or aluminum, for example. The rolling can be hot rolling, for example, in particular in a multi-stand production line of a hot rolling mill.

Figure 2:
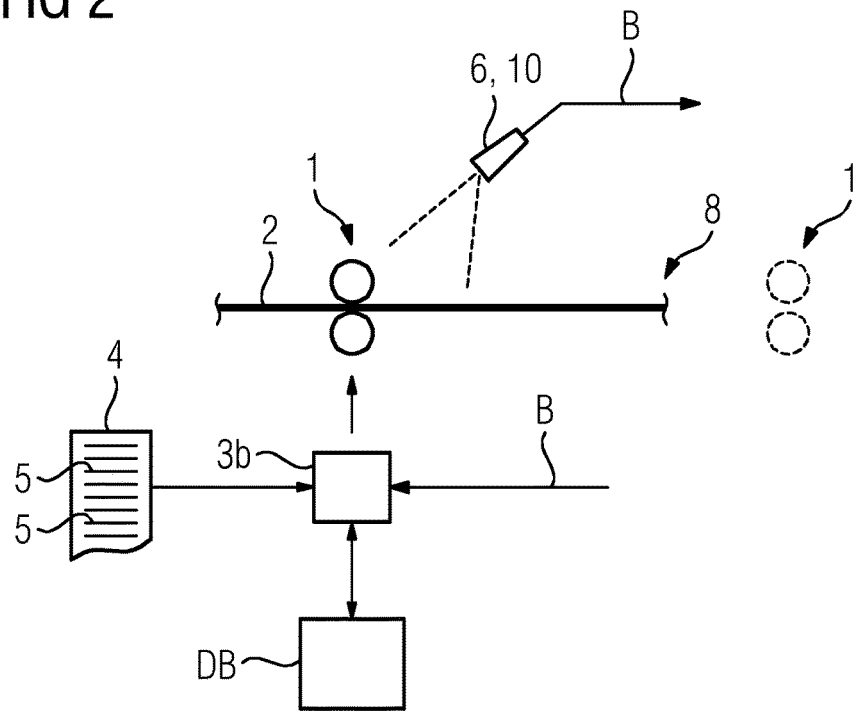
FIG. 2 shows a single roll stand with assigned components.

FIG. 2 shows a single roll stand 1. A metal strip 2 is likewise being rolled in the roll stand of FIG. 2. The roll stand 1 can be one of the roll stands 1 of the rolling mill train of FIG. 1. Therefore, a further roll stand 1 of the rolling mill train is additionally shown in FIG. 2. This further roll stand 1 is depicted only in broken lines, however, since only the roll stand 1 depicted in solid lines matters for FIG. 2 and the other Figures. Therefore, the explanations that follow relate to this roll stand 1. Alternatively, a reversing stand may be involved, in which the metal strip 2 is rolled in reverse. In this case, the roll stand 1 may be the only roll stand in which the metal strip 2 is rolled. The roll stand 1, just like the roll stands 1 of FIG. 1, is controlled by a control device 3*b* with a stand controller 3*a*, whereby the control device 3*b* is able to have a coordination device 3*c* on a higher level.

Each control device 3*b* is programmed with a control program 4. This is shown in FIG. 1 and FIG. 2 only for one of the control devices 3*b*. The control program 4 comprises machine code 5 that can be executed by the control device 3*b*. The execution of the machine code 5 by the control device 3*b* causes the control device 3*b* to control the roll stand 1 using a control method that is explained in more detail below. This first involves an explanation of a mode that also takes place in the prior art, and later a discussion of features according to the invention.

Figure 3:
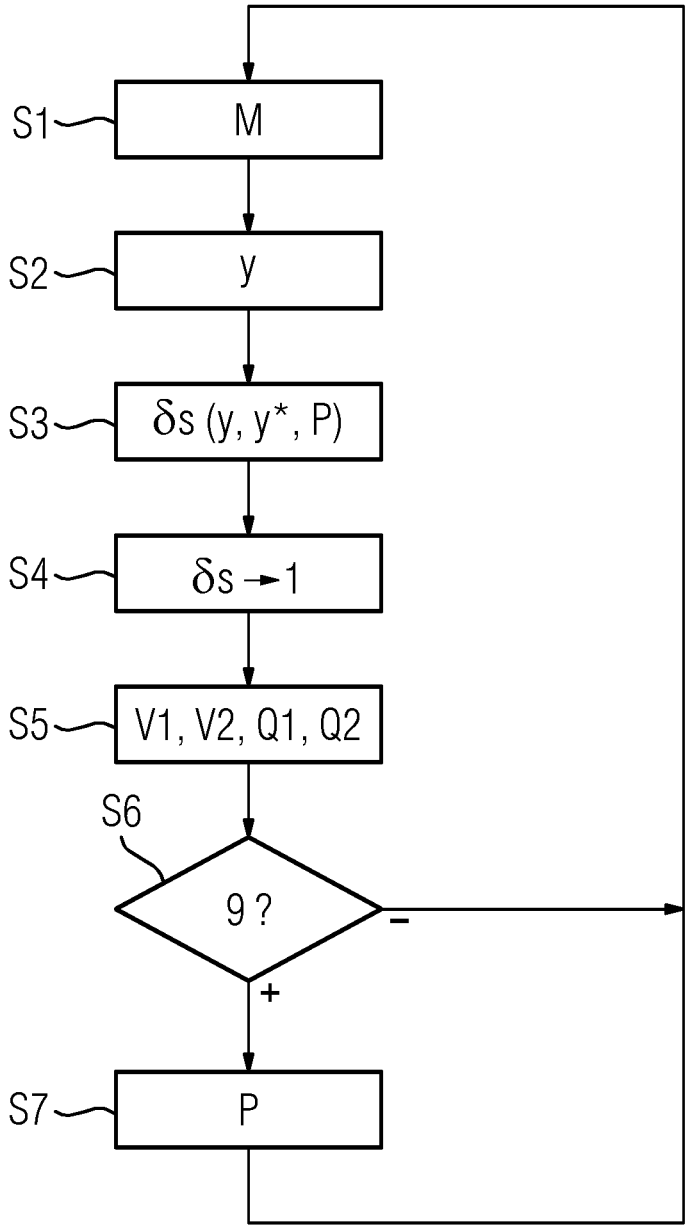
FIG. 3 shows a flowchart.

The control device 3*b* receives measurement data M from a capture device 6 in FIG. 2. See also a step S1 in FIG. 3. The measurement data M are received while the metal strip 2 is being rolled in the roll stand 1. The measurement data M are characteristic of a lateral position y of the metal strip 2 that exists on the exit side of the roll stand 1 according to the depiction in FIG. 4. The control device 3*b* therefore ascertains the lateral position y of the metal strip 2 from the measurement data M in a step S2. It takes the deviation in the lateral position y from a desired position y* as a basis for ascertaining a pivot value δs for the roll stand 1 in a step S3. As a starting point, the ascertainment involves the lateral position y of the metal strip 2 being brought closer to the desired position y*. The stand controller 3*a* actuates the roll stand 1 according to the ascertained pivot value δs in a step S4.

When ascertaining the pivot value δs, the stand controller 3*a* takes account of not only the deviation in the lateral position y from a desired position y*, but additionally also at least one parameter P, and usually multiple parameters P. Parameters P are somewhat different than a variable. A variable is a quantity that changes in each cycle of the stand controller 3*a*. Typical variables are the desired value y*, the actual value y and the manipulated quantity δs. Parameters P, on the other hand, are values that are normally prescribed for the stand controller 3*a* only once and then constantly retained throughout the control operation, that is over a multiplicity of cycles. In the case of a conventional PI controller, for example, the parameter P can be a proportional gain or an integration time constant. For a stand controller 3*a*, as is used in the present case and known from the aforementioned EP 3 202 502 A1, for example, the parameters P can declare for example a maximum permissible value for the pivot value δs or a maximum value for the change in the pivot value δs from cycle to cycle of the stand controller 3*a*. The maximum permissible value for the pivot value δs can be declared separately for the two pivot directions if necessary.

To the extent explained above, the operation of the control device 3*b* corresponds to normal strip position control as is known generally and also as explained in detail in EP 3 202 502 A1, for example. This approach forms the basis for the present invention.

This is because, according to the invention, in a step S5, the control device 3*b* ascertains at least one quantity V1, V2, Q1, Q2 that reveals, for both strip edges 7, 8 of the metal strip 2 (see FIG. 4), whether the metal strip 2 is forming a wave 9 (see FIG. 5) in the region of the respective strip edge 7, 8. In a step S6, the control device 3*b* uses the at least one quantity V1, V2, Q1, Q2 to check whether and if necessary at which strip edge 7, 8 the metal strip 2 is forming a wave 9.

If the check in step S6 has a negative outcome, that is no wave 9 is detected, a step S7 is skipped. If the check in step S6 has a positive outcome, that is a wave 9 is detected, on the other hand, the control device 3*b* moves to step S7. In step S7, the control device 3*b* varies at least one of the parameters P of the stand controller 3*a*. From this time onward, that is from the varying of the at least one parameter P onward, the stand controller 3*a* ascertains the pivot value δs in light of the varied parameter P.

The control device 3*b* varies the parameter P such that the formation of the wave 9 is prevented or an extent h to which the wave 9 forms is limited to a predetermined degree. In particular, the control device 3*b* can vary the parameter P that declares the maximum permissible value for the pivot value δs. In particular, the absolute value of this value can be reduced from its currently valid value. The varying can alternatively be carried out for both pivot directions or just for the pivot direction that is responsible for the wave 9 that has arisen.

In contrast to the approach of the prior art, wherein the wave is not automatically taken into account, the present invention therefore involves the pivot value δs being ascertained in light of the circumstance of whether the metal strip 2 is forming a wave 9 in the region of one of its strip edges 7, 8.

The varied parameter P is retained by the control device 3*b* as time goes by until a specific event occurs on the basis of which the value of the applicable parameter P is varied again. If the absolute value of the parameter P is reduced for both pivot directions, a specific event of this kind is that another wave 9 is detected at one of the strip edges 7, 8 despite the variation of the parameter P that was just mentioned. If the absolute value of the parameter P is reduced for the respective pivot direction only, a specific event of this kind is that, despite the variation of the parameter P that was just mentioned, another wave 9 is detected at the same strip edge 7, as previously. Other specific events are a change in the rolling process.

Figure 6:
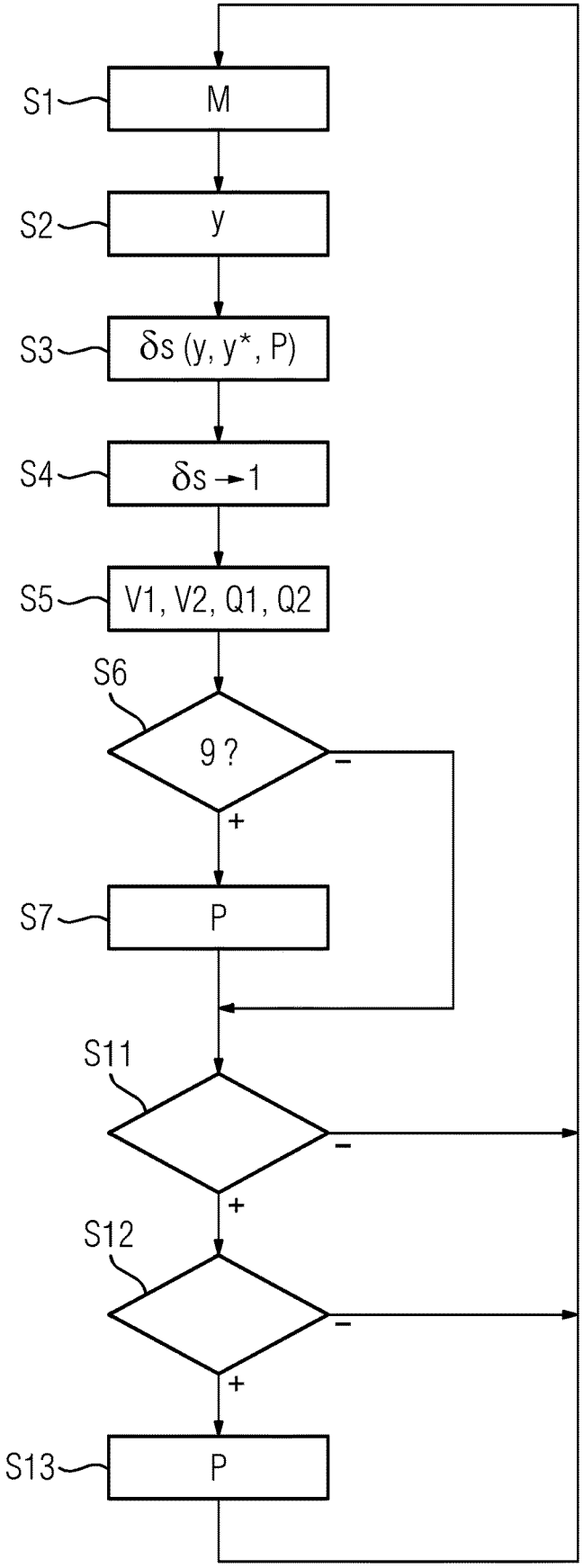
FIGS. 6 to 9 show flowcharts.

In particular, according to the depiction in FIG. 6, it is possible for the control device 3*b* to check, in a step S11, whether the tensile state Z of the metal strip 2 has changed. The tensile state Z changes in particular when there is a transition from rolling the metal strip 2 under tension to rolling the metal strip 2 without tension or, vice versa, a transition from rolling the metal strip 2 without tension to rolling the metal strip 2 under tension. A change from rolling the metal strip 2 without tension to rolling the metal strip 2 under tension generally occurs in particular when a strip head 11 of the metal strip 2 enters a downstream device, for example is threaded into the downstream roll stand 1 in the case of a multi-stand rolling mill train. Conversely, a change from rolling the metal strip 2 under tension to rolling the metal strip 2 without tension occurs when a strip tail of the metal strip exits an upstream device, for example is threaded out of the upstream roll stand of a multi-stand rolling mill train.

Alternatively or additionally, the control device 3*b* can check, in a step S12, whether the metal strip 2 has been completely rolled in the roll stand 1. In this case, the parameters P can be declared again in a step S13.

Figure 7:
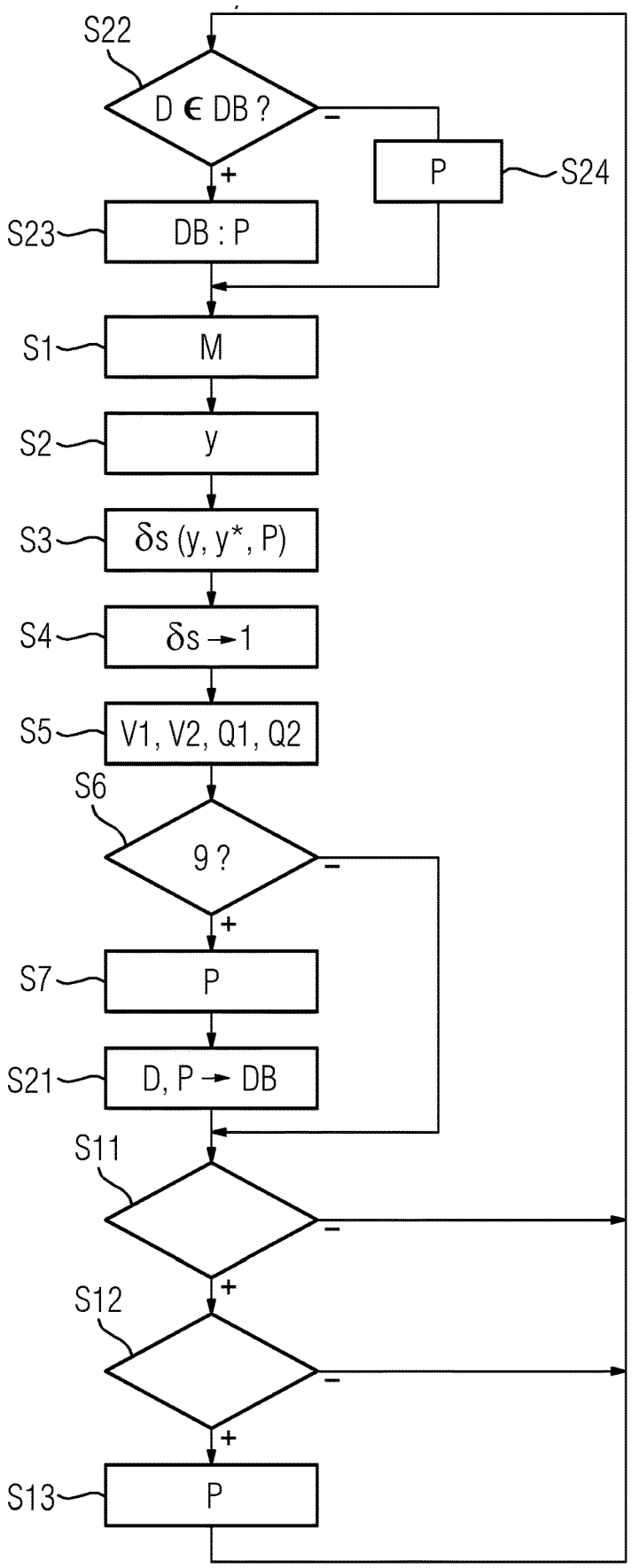

It is possible to always declare the parameters P to have the same values. Preferably, the procedure from FIG. 6 is complemented by steps S21 to S24 in accordance with the depiction from FIG. 7, however.

Step S21 is performed when the control device 3*b* varies the at least one parameter P. In this case, the control device 3*b* supplies the varied parameter P to a database DB (see FIG. 2) in association with data D that are characteristic of the rolled metal strip 2. This allows the control device 3*b*, prior to rolling a respective metal strip 2, to use characteristic data D for the new metal strip 2 to be rolled to check in step S22 whether parameters P are already stored in the database DB for such a metal strip 2 or a metal strip 2 having sufficiently similar characteristic data D. If such parameters P are stored, the control device 3*b* can retrieve these parameters P from the database DB as initial values in step S23. Otherwise, the control device 3*b* can calculate standard values for the parameters P in step S24.

Figure 4:
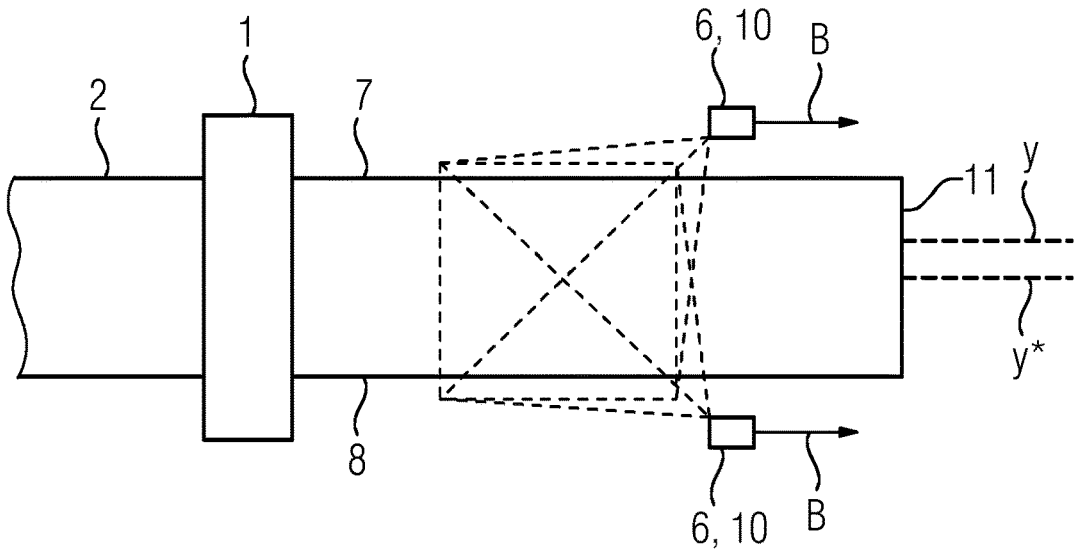
FIG. 4 shows a roll stand and a metal strip viewed from above.
Figure 5:
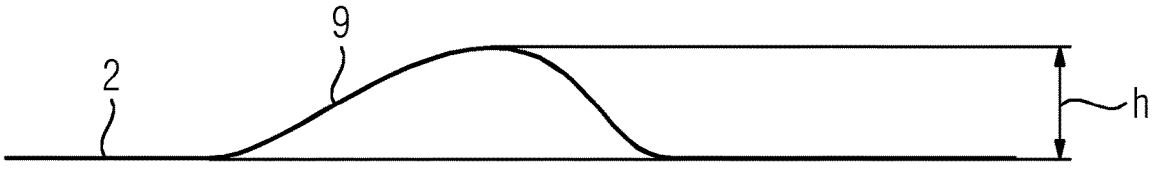
FIG. 5 shows a metal strip with a wave from the side.

The measurement data M can be determined as required. The capture device 6 is also designed accordingly. Preferably, the capture device 6 is in the form of a single camera 7 or, as seen in FIG. 4, in the form of a group of cameras 10. In this case, the measurement data M are images B or groups of images B.

It is possible for the groups of images B to each comprise just a single image B. In this case, the respective image B is referenced to a respective capture time. As already mentioned, the capture device 6 may also be in the form of a group of cameras 10, however. In this case, the cameras 10 each capture a separate image B. In this case, the individual cameras 10 each capture their respective image B at a consistent capture time. In this case, the images B of the respective group are thus referenced to a respective consistent capture time.

Preferably, the control device 3*b* does not just use the groups of images B in step S2, that is when ascertaining the lateral position y of the metal strip 2. Instead, the control device 3*b* preferably also uses the groups of images B in step S5 to ascertain the at least one quantity V1, V2, Q1, Q2 that reveals, for both strip edges 7, 8 of the metal strip 2, whether the metal strip 2 is forming a wave 9 in the region of the respective strip edge 7, 8.

As already mentioned, the groups of images B can each comprise more than one image B. For example, in accordance with the depiction in FIG. 4, there may be multiple cameras 10 present that each capture a separate image B. In this case, the control device 3*b* can preprocess the images B captured at a consistent capture time so that it ascertains the three-dimensional surface of the metal strip 2. In this case, the control device 3*b* uses the ascertained three-dimensional surface of the metal strip 2 in step S5. Similarly, there is also the possibility that, although only a single image B is captured per group of images B, the single image B already contains the required three-dimensional information. In this case, the applicable image B is a so-called depth image. In this case too, the control device 3*b* uses the three-dimensional surface of the metal strip 2 in step S5.

Figure 8:
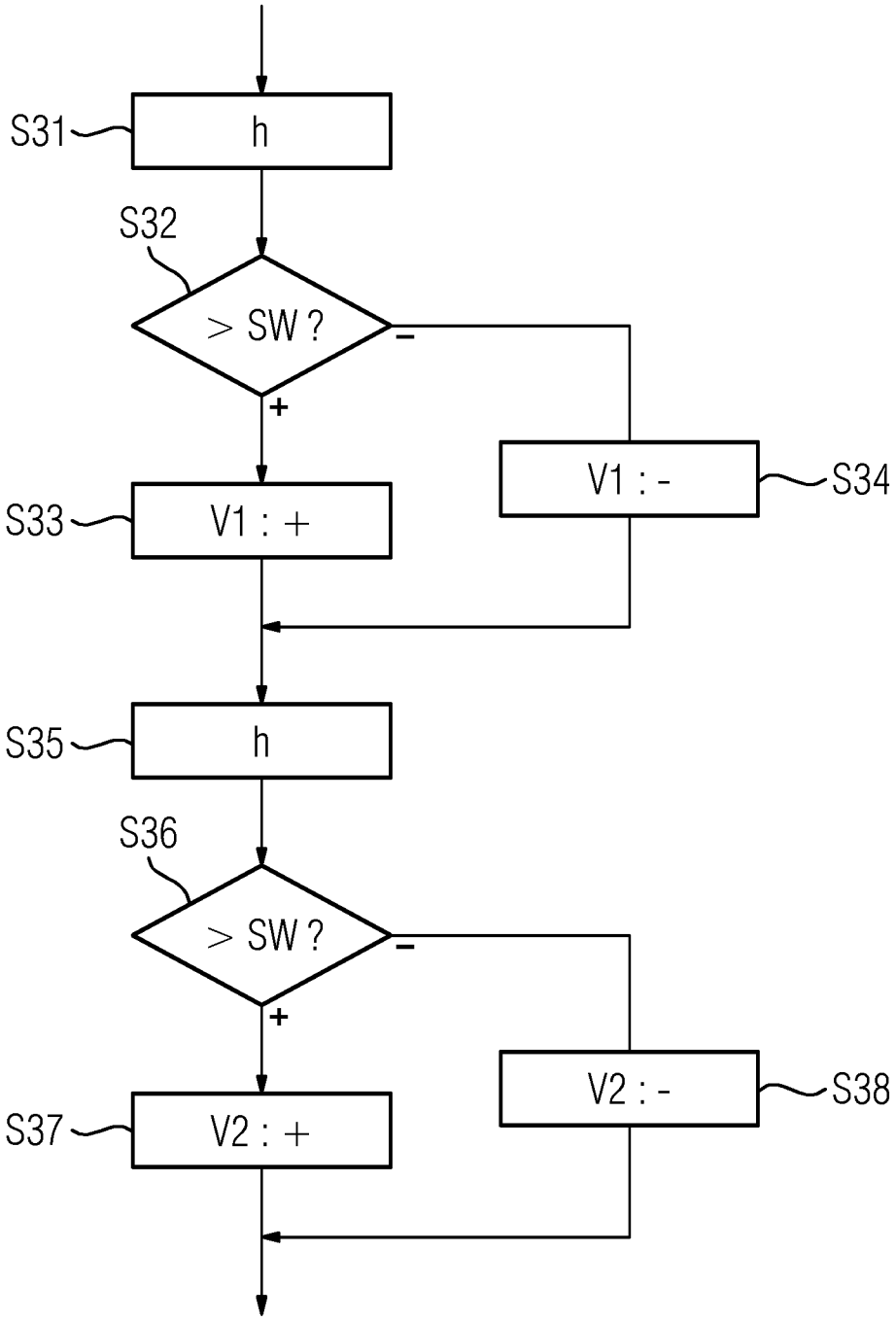

To implement step S5, that is to ascertain the at least one quantity V1, V2, Q1, Q2 that reveals, for both strip edges 7, 8 of the metal strip 2, whether the metal strip 2 is forming a wave 9 in the region of the respective strip edge 7, 8, the control device 3*b* can, in a step S31, while evaluating the respective group of images B for one strip edge 7, 8 of the metal strip 2, ascertain an extent of a wave 9, to which the metal strip 2 forms the wave 9 in the region of the strip edge 7, 8, in accordance with the depiction in FIG. 8. For example, the control device 3*b* can ascertain the height h of the wave 9.

To ascertain the extent of the wave 9, the control device 3*b* executes an algorithm in the broader sense. For example, the control device 3*b* can be programmed with a learning algorithm, machine learning algorithm, wherein a multiplicity of groups of images B are prescribed for the learning algorithm in a learning phase in advance, that is before performance of the control method from FIG. 3, and, in addition to the respective group of images B, the associated extent, for example the height h of the wave 9, is also communicated, as a result of which the control device 3*b* was able to "learn" the correct evaluation. As an alternative to the extent, a piece of Boolean information derived from the extent can also be supplied to the control device 3*b*. During later operation, during performance of the control method from FIG. 3, only the respective group of images B is then prescribed for the learning algorithm, and the control device 3*b* uses the learning algorithm to determine the associated extent or the Boolean information derived therefrom. Alternatively or additionally, a different piece of information can be supplied to the control device 3 as part of the learning process, for example control interventions by operators during the rolling of the metal strip 2. An example of a suitable learning algorithm is a neural network, in particular a DNN=deep neural network. The design and manner of training of a neural network of this kind are explained for example in the technical paper by Zhong-Qiu Zhao mentioned at the outset.

In a step S32, the control device 3*b* checks whether the ascertained extent exceeds a predetermined threshold value SW. If this is the case, the control device 3*b* sets a Boolean variable V1 to the value TRUE in a step S33. Otherwise, the control device 3*b* sets the Boolean variable V1 to the value FALSE in a step S34.

In steps S35 to S38, the control device 3*b* ascertains the value of a Boolean variable V2 for the other strip edge 8 in a totally analogous manner.

In the procedure according to FIG. 8, the Boolean variables V1, V2 are thus the at least one quantity that reveals whether the metal strip 2 is forming a wave 9 in the region of the respective strip edge 7, 8. Instead of the two Boolean variables V1, V2, it would naturally also be possible to use one variable having at least three values. By way of example, the value +1 could be used for a wave 9 at one strip edge 7, the value −1 could be used for a wave 9 at the other strip edge 8 and the value 0 could be used for no wave 9.

Figure 9:
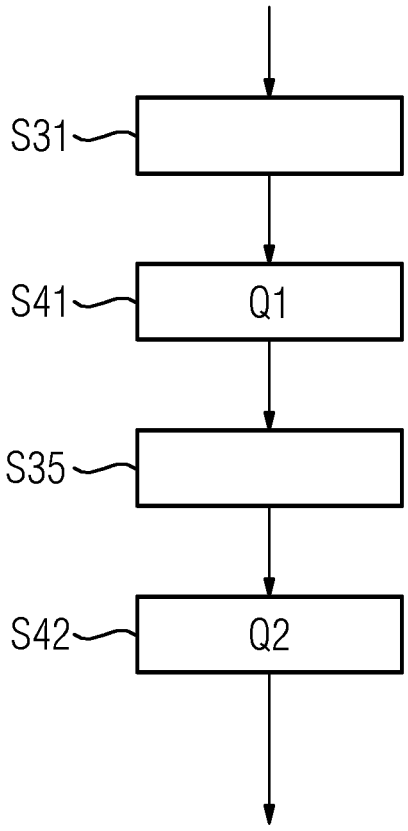

The procedure from FIG. 9 is similar to the procedure from FIG. 8. Steps S32 to S34 and S36 to S38 can be dispensed with, however. Instead, steps S41 and S42 are present. In step S41, the control device 3*b* ascertains a quantified value Q1 for the extent ascertained in step S31. In the simplest case, the control device 3*b* accepts the extent ascertained in step S31 in step S41. Preferably, however, the control device 3*b* uses the extent ascertained in step S31 as quantified value Q1 to ascertain the associated I unit of the metal strip 2 in the region of the strip edge 7, 8 in step S41.

In an analogous manner, the control device 3*b* ascertains a quantified value Q2 for the extent ascertained in step S35 in step S42.

In the case of the configuration according to FIG. 9, the quantified values Q1, Q2 thus represent the at least one quantity that reveals whether the metal strip 2 is forming a wave 9 in the region of the respective strip edge 7, 8. Instead of the two quantified values Q1, Q2, it would naturally also be possible to use a consistent variable that indicates the height h of the wave 9 at one strip edge 7 in the case of a positive value and the height h of the wave 9 at the other strip edge 8 in the case of a negative value, for example.

In accordance with the depiction in FIG. 4, the images B show the metal strip 2 on the exit side of the roll stand 1 in a relaxed state. This is the case anyway if the roll stand 1 is configured as a pure reversing stand. If the roll stand 1 is configured as part of the multi-stand rolling mill train from FIG. 1, the situation arises for the time range in which although the strip head 11 of the metal strip 2 has already passed through the roll stand 1, it has not yet reached the further roll stand 1 shown in in broken lines. For example, if the roll stand 1 has coil boxes or similar devices arranged upstream and downstream of it, this applies in each case up to the time at which the strip head 11 reaches the respective coil box. Similar statements apply to the strip tail.

At a reversing stand, the metal strip 2 is rolled in reverse. The exit side of the roll stand 1 therefore changes with each rolling pass. For a reversing stand, the term "exit side" is therefore not static, but rather dynamic with reference to the respective rolling pass. The same applies to the term "entry side".

The present invention has been explained above in conjunction with a capture of the lateral position y on the exit side of the roll stand 1. This is the norm for the present invention. Alternatively or additionally, however, it is likewise possible to carry out the procedure for the entry side of the roll stand 1.

The present invention has many advantages. In particular, the approach according to the invention allows detection and correction of not only a fault in the strip path but also a fault when a wave 9 is produced. The detection of waves 9 as such in the captured images B can be implemented without any difficulty. The approach according to the invention can be used in particular for automated optimization of the operation when the metal strip 2 is threaded into a downstream roll stand 1 or in general when the metal strip 2 enters a downstream device. Additionally, the requisite hardware for capturing and using the images B is usually present anyway, which means that only the costs for the associated software are incurred.

Although the invention has been illustrated and described more thoroughly in detail by the preferred exemplary embodiment, the invention is not restricted by the disclosed examples, and other variants can be derived therefrom by a person skilled in the art without departing from the scope of protection of the invention.

LIST OF REFERENCE SIGNS

1 Roll stand
2 Metal strip
3 Control device
3*a* Stand controller
3*b* Automation device
4 Control program
5 Machine code
6 Capture device
7, 8 Strip edges
9 Waves
10 Cameras
11 Strip head
B Images
D Data
DB Database
h Height
M Measurement data
P Parameter
Q1, Q2 Quantified values
S1 to S42 Steps
SW Threshold value
V1, V2 Boolean variable
x Rolling direction
y Lateral direction
y* Desired position
Z Tensile state
δs Pivot value

The invention claimed is:

1. A control method for a roll stand comprising:

rolling a metal strip in the roll stand;

providing a control device for the roll stand for receiving measurement data (M) for a lateral position (y) of the metal strip that exists on an entry side and/or on an exit side of the roll stand;

operating a stand controller of the control device to take account of parameters (P) of the stand controller in taking a deviation in the lateral position (y) from a desired position (y*) as a basis for ascertaining a pivot value (δs) for the roll stand; and actuating the roll stand accordingly, ascertaining by the control device at least one quantity (V1, V2, Q1, Q2) that reveals, for both strip edges of the metal strip, whether the metal strip is forming a wave in a region of one of the strip edges; and as soon as the metal strip forms the wave in the region of one of the strip edges, the control device varying at least one of the parameters (P) of the stand controller, such that the stand controller ascertains the pivot value (as) from the varying of the at least one parameter (P) onward in the light of the varied parameter (P).

2. The control method as claimed in claim 1, further comprising the control device varying the at least one of the parameters (P) such that the formation of the wave is prevented or an extent (h) to which the wave forms is limited to a predetermined degree.

3. The control method as claimed in claim 1, further comprising causing the control device to retain the varied parameter (P) until either the control device varies the parameter (P) again on the basis of a further formation of the wave in the metal strip or a tensile state (Z) of the metal strip changes or the metal strip has been completely rolled in the roll stand.

4. The control method as claimed in claim 1, further comprising operating the control device to supply the varied parameter (P) to a database (DB) in association with data (D) that are characteristic of the rolled metal strip, making the varied parameter (P) available as an initial value for the parameter (P) when a further metal strip having the same or sufficiently similar characteristic data (D) is rolled.

5. The control method as claimed in claim 1, further comprising:

the measurement data (M) that the control device receives for the lateral position (y) of the metal strip comprise groups of images (B) of the metal strip that show the metal strip as it exits the roll stand and/or as it enters the roll stand, and referencing the images (B) of the groups each being referenced to a capture time that is consistent for the respective group.

6. The control method as claimed in claim 5, further comprising:

determining the groups of images (B) such that they allow a three-dimensional determination of the surface of the metal strip.

7. The control method as claimed in claim 5 further comprising with the control device ascertaining the at least one quantity (V1, V2, Q1, Q2) that reveals, for both strip edges of the metal strip, whether the metal strip is forming the wave in the region of the respective strip edge, on the basis of the groups of the images (B) of the metal strip.

8. The control method as claimed in claim 7, further comprising:

operating the control device to use the respective group of images (B) to ascertain a respective extent to which the metal strip forms the wave in the region of the respective strip edge;

comparing the respective ascertained extent with a threshold value (SW); and ascertaining the at least one quantity (V1, V2) on the basis of the respective comparison as a respective Boolean variable (V1, V2).

9. The control method as claimed in claim 7, further comprising operating the control device to use the respective group of images (B) to quantitatively ascertain a respective extent to which the metal strip forms the wave in the region of the respective strip edge; and to use quantified values (Q1, Q2) as at least one quantity (Q1, Q2).

10. The control method as claimed in claim 9, further comprising, operating the control device to ascertain the quantified values (Q1, Q2) in I units.

11. The control method as claimed in in claim 1, further comprising leaving the metal strip in a relaxed state upstream and/or downstream of the roll stand while the control method is being performed.

12. A control program product, comprising machine code stored on a non-transitory medium that can be executed by the control device for the roll stand of claim 1, to cause the control device of the roll stand of claim 1 to perform the control method as claimed in claim 1.

13. The control device for the roll stand of claim 1, wherein the control device for the roll stand of claim 1 is programmed for causing the control device of the roll stand of claim 1 to perform the control method as claimed in claim 1 during operation.

14. A roll unit, wherein the roll unit has the roll stand of claim 13 in which the metal strip is rolled, wherein the roll unit has the control device as claimed in claim 13, and wherein the roll stand is controlled by the control device as claimed in claim 13.

15. A rolling mill train, wherein the rolling mill train has multiple roll stands, the roll stands are arranged in succession as seen in a rolling direction (x), as a result of which they carry the same section of the metal strip one after the other, wherein at least one of the roll stands is in the form of the roll unit as claimed in claim 14.

* * * * *